US010475608B2

(12) United States Patent
Whitman

(10) Patent No.: US 10,475,608 B2
(45) Date of Patent: Nov. 12, 2019

(54) SLIDABLE MAGNETIC SWITCH FOR ACTUATING A MAGNETIC SENSOR

(71) Applicant: Jonathan Whitman, Lakewood, NJ (US)

(72) Inventor: Jonathan Whitman, Lakewood, NJ (US)

( * ) Notice: Subject to any disclaimer, the term of this patent is extended or adjusted under 35 U.S.C. 154(b) by 0 days.

(21) Appl. No.: 16/197,978

(22) Filed: Nov. 21, 2018

(65) Prior Publication Data

US 2019/0164709 A1 May 30, 2019

(51) Int. Cl.
*H01H 36/00* (2006.01)
*G08B 21/24* (2006.01)

(52) U.S. Cl.
CPC ..... *H01H 36/0013* (2013.01); *G08B 21/24* (2013.01); *H01H 2221/068* (2013.01)

(58) Field of Classification Search
CPC ..... H01H 36/00; H01H 2221/00; G08B 21/00
USPC ..... 307/116
See application file for complete search history.

(56) References Cited

U.S. PATENT DOCUMENTS 2,873,333 A 2/1959 Jacaman
4,726,063 A 2/1988 Chahley et al.
4,798,916 A 1/1989 Engel et al.
4,810,833 A 3/1989 Meyers
4,914,265 A 4/1990 Mongeau
4,968,856 A 11/1990 Bowley et al.
4,972,045 A 11/1990 Primeau
5,449,860 A 9/1995 Buckshaw et al.
5,934,919 A 8/1999 Cross et al.
5,998,747 A 12/1999 Kelso et al.
6,669,492 B1 12/2003 McIlvenna
6,934,220 B1 * 8/2005 Cruitt ..... A61J 7/0481 368/10

(Continued)

OTHER PUBLICATIONS

SmpliSafe, Door Sensor Screts: What They Are, How They Work & 6 Unexpected Uses, Cara Glaimo, Jul. 24, 2013 [date accessed May 17, 2018]: https://simplisafe.com/blog/door-sensor-secrets.

(Continued)

*Primary Examiner* — Hal Kaplan
*Assistant Examiner* — Joseph N Inge
(74) *Attorney, Agent, or Firm* — Michael J. Feigin, Esq.; Feigin and Fridman LLC

(57) ABSTRACT

A slidable magnetic switch for controlling the electronic functions of an appliance on the Jewish Sabbath is disclosed herein. A housing with an integrated magnetic slider is permanently attached to the appliance surface directly adjacent to and above its embedded magnetic sensor, whereupon the magnetic force of the extended slider opens the sensor's electrical circuit and disables various auxiliary electronic functions whose operation is prohibited on the Sabbath. The slider is pushed back inside the housing after the Sabbath ends, allowing the sensor's electrical circuit to return to its regularly closed position, enabling the appliance's electronic functions for normal weekday operation. A timer alarm switch mounted within the housing provides an audible reminder to manually activate the magnetic switch each week before the Sabbath begins, or alternatively, to automatically extract the slider from the housing before the Sabbath commences, and retract the slider into the housing after the Sabbath concludes.

14 Claims, 8 Drawing Sheets

(56) References Cited

U.S. PATENT DOCUMENTS

| | | | | |
|---|---|---|---|---|
| 6,974,925 | B2 * | 12/2005 | Whitman | H01H 3/20 200/333 |
| 2006/0234046 | A1 * | 10/2006 | Wu | H01F 1/113 428/352 |
| 2013/0286623 | A1 * | 10/2013 | Slipy | H04M 1/0202 361/807 |
| 2018/0238614 | A1 * | 8/2018 | Ayan | F25D 29/00 |

OTHER PUBLICATIONS

Dobroeutro Door Design, Refrigerator Door Sensor Reed Switch in Refrigerator Door Whirlpool Refrigerator Door Sensor, Mar. 11, 2018 [dated accessed May 17, 2018]: http://dobroeutro.me/refrigerator-door-sensor/refrigerator-door-sensor-reed-switch-in-refrigerator-door-whirlpool-refrigerator-door-sensor/.

* cited by examiner

SLIDABLE MAGNETIC SWITCH FOR ACTUATING A MAGNETIC SENSOR

BACKGROUND OF THE DISCLOSURE

"On the seventh day God had finished his work of creation, so he rested from all his work. And God blessed the seventh day and declared it holy, because it was the day when he rested from all his work of creation" (Genesis 2:2); "Remember to observe the Sabbath day by keeping it holy" (Exodus 20:8). For orthodox Jews, the observance of the holy Sabbath requires the complete refrainment from any and all acts of creation, by maintaining the status quo in all manner of form and function, from Sabbath eve Friday sundown through Sabbath day Saturday night. And so, as with all new technology, when electricity became commonplace in Jewish homes, the leading rabbinic scholars of that generation were tasked with deciding whether its use was permitted or forbidden on the Sabbath.

After careful consideration, and not an insignificant amount of debate, the accepted conclusion of codified Jewish law was that the use of electricity was permissible in and of itself, however, the act of actually turning the electricity either on or off was strictly forbidden because it involved the fundamental process of creation or destruction by closing or opening electrical circuits. The practical effect therefrom means that, for example, while the use of electric lights during the Sabbath is fully permitted, they must be turned on before the Sabbath begins Friday evening, and remain on throughout the following day until the Sabbath ends Saturday night. Likewise, any light ordinarily turned off at night must be off before the Sabbath begins and remain off until it ends the following day, all of which is necessary in order to avoid the indirect, but still forbidden act of closing or opening an electronic circuit on the Sabbath itself. sFor decades, major kitchen appliances—refrigerators, freezers, and ovens—have utilized external, physically-triggered, spring-loaded sensor switches to detect when their doors were opened and closed. Until more recently, this mechanism was used exclusively for controlling the internal lights, presenting a unique, but solvable problem for orthodox Jews on the Sabbath, who are proscribed from performing any action, directly or indirectly, that inevitably results in the completion or interruption of an electronic circuit, such as turning electric lights on or off by opening or closing an appliance door.

The solution in many Jewish homes to this formidable problem has long been to either unscrew the light bulbs or tape down the appliance sensor switches before the Sabbath starts, thereby preventing the circuits from being completed and the lights from turning on, and to afterward restore the light bulbs or remove the tape once the Sabbath ends. Because of this enormous inconvenience, and more crucially because of the severity of an even unintended transgression, however, this weekly custom has given way to the near universal practice of removing the appliance light bulbs completely, or taping down the sensor switches permanently, in order to avoid accidentally forgetting to deactivate them every Friday evening, resulting in the sub-optimal operation of darkened appliances for the entire week.

As long as these mechanical sensor switches controlled nothing more than the lights themselves, permanently removing the light bulb or restraining the spring sensor switch in a closed position has been the traditional rite of passage for most observant Jewish families upon the purchase of a new appliance, requiring little to no effort or expense to achieve, and involving nothing more than mere inconvenience. With the advent of more modern and sophisticated appliances that now utilize magnetic rather than spring sensor switches, however, a completely new and far more complicated set of problems has arisen which can no longer be so easily addressed, requiring a far more modern and sophisticated solution in order to maintain the sanctity of the Sabbath while operating these appliances.

First, instead of regulating only the interior lights, the new magnetic sensor switches now control a myriad of other critical electronic functions, including control panels, recirculating fans, defrost timers, humidity regulators, expansion valves, and heating elements, none of which can be manually disabled in likewise fashion as a light bulb. Even the interior lights themselves are no longer removable, as they have been replaced with LED bulbs that are built into the appliance housings and cannot be accessed.

Second, the older external, depressible spring sensor switches that used to be easily manipulated by simply sticking them down in the off position have now been supplanted by these newer internal and inaccessible magnetic sensor switches that are embedded beneath the exterior surface of the appliances, and that require proximity engagement with similarly internal and inaccessible magnets that are installed inside the exterior door frames of the appliances, in order to detect when the doors are opened or closed.

While there are a few high-end, expensive appliances with factory "Sabbath Mode" features that purport to deactivate much of the offending electronics, they comprise a predominantly niche market that serves only a limited few, not only because of their high cost, but also because many rabbinic authorities discourage their use after discovering operational anomalies that rely upon controversial interpretations of causation inconsistent with their stricter rulings of Jewish law.

A common independent, inexpensive, and universal solution to this complex Sabbath problem is to replicate the functionality of the interior-installed door magnet by affixing a separate external magnet onto the appliance surface directly opposite the location of the installed magnetic sensor switch where the closed-door magnet would normally be, such that even when the appliance door is opened, the electrical circuit of the magnetic sensor remains opened and thus disabled, as if the door itself is closed.

In practice, however, this is both unworkable and inadvisable because virtually every appliance surface is constructed from a plastic polymer incapable of attracting magnets, and the magnetic surface itself is resistant to bonding with adhesive. Even if a reliable attachment could be achieved, the owner is faced with the same predicament as before of either remembering to install the magnet each week prior to the Sabbath or leaving the magnet in place all week long, which not only disables the lights, but more importantly, shortens the appliance lifespan by severely compromising its essential operating functions.

These and other shortcomings of current technology need a better solution for Sabbath observant Jews who wish to fully utilize modern appliances seven days a week without dishonoring their faith, and without causing permanent damage to their appliances.

SUMMARY OF THE DISCLOSED TECHNOLOGY

A magnetic Sabbath switch, in embodiments of the disclosed technology, has a housing, which has four sides: front, back, left, and right, and further has a top side and bottom side. Within this housing is a cutout section, such as a rectangular section extending partially or mostly through from the top to the bottom, and from one of the left or right sides towards the opposite right or left side. At a top of this cutout section are, in some embodiments of the disclosed technology, a plurality of arched ridges. This cutout section can be substantially or fully covered by a slider with an integrated magnet that physically engages with fixed lateral tracks within the front and back-most extent and length thereof.

In the closed position, the magnet is situated above a vertical plane defined by the bottom side of the housing, which is flat or substantially flat and sits within an imaginary bottom plane. If one were to extend this imaginary plane upwards towards the top side from the bottom side, this defines the vertical plane extending from the outline of the bottom side. In the closed position, the magnet connected to the slider is within this vertical plane. In the opened position, the magnet is outside of this vertical plane.

In the closed position, in embodiments of the disclosed technology, the confines of the housing preclude the sliding magnet from reversing the circuitry of the appliance magnetic sensor by shielding it from any overhead contact, whereas in the opened position, in embodiments of the disclosed technology, the sliding magnet is located directly above, and is thus within the virtual vertical plane of the embedded magnetic sensor, allowing it to freely actuate the electronic circuitry through the use of a magnetic field. That is, when the slider is in the opened position, the magnet is outside of the physical vertical plane of the housing and acts, through a magnetic force, on the magnetic sensor switch situated directly below the appliance surface to open the circuit, disrupt the flow of electricity, and turn off auxiliary functions such as internal lights, control panels, recirculating fans, defrost timers, humidity regulators, expansion valves, heating elements, and more, all of which require electrical power to operate, and all of which are disabled by the magnetic sensor in the normal course when the appliance door is closed.

The appliance magnetic sensor, in some embodiments of the disclosed technology, has a common lead through which an electrical current passes, and two alternating leads, one that closes the circuit and allows the current to energize these appliance functions, and another that opens the circuit to interrupt the flow of current thereto. The sensor switch itself can be partly magnetized, such that the common lead and the closed lead are magnetically bonded in their normal state when the door is opened. When the door is closed, a larger, stronger magnet located within the door frame itself is situated over the weaker magnetic bond of the appliance sensor, thus forcing the common lead away from the closed lead and onto the open lead, and in the process, interrupting the flow of electricity to and thus disabling the appliance's auxiliary functions. This all takes place out of view of the user in some embodiments of the disclosed technology, such that the only evident action is that when the door opens, the lights and auxiliary electronic functions turn on, and when the door closes, these auxiliary electronic functions turn off.

In sum and substance, the operation of the magnetic Sabbath switch replicates the normal action of opening and closing an appliance door. In the opened position, the magnet engages the magnetic sensor by interrupting the electrical current to the auxiliary appliance functions, in exactly the same way as when the door is closed. In the closed position, the magnetic sensor operates without magnetic interference by supplying the electrical current to those functions, in exactly the same way as when the door is opened.

The housing of the magnetic Sabbath switch can be attached to the appliance surface by way of an adhesive pad fixedly adhered to the bottom side, or alternatively by way of a rare-earth magnet that is similarly joined to the bottom, when installed on metallic surfaces. This permanent attachment is made, in some embodiments of the disclosed technology, at a fixed location directly adjacent to, and outside of the plane that extends away from the interiorly-found appliance magnetic sensor, and above the exterior surface of the appliance. That is, the housing is installed both next to and above the area of the magnetic sensor, which should be understood to mean any sensor within an appliance operated by magnetic force, but does not cover the area where the magnetic sensor is thereunder. Rather, one extends a movable slider containing the magnet over the contiguous area that is located within the virtual vertical plane extending upwardly from the magnetic sensor and continuing perpendicular to the physical, horizontal plane of the slider, under which the appliance magnetic sensor resides.

The housing of the magnetic Sabbath switch, in some embodiments of the disclosed technology, extends mostly downward across its length, leaving a discernable space widthwise under the leading edge of the housing by which to provide the necessary extra vertical clearance therebeneath to accommodate the raised appliance sensor cover commonly used to identify the location of the hidden magnetic sensor, as well as to provide service access thereto, in order to ensure the proper operation of the device.

When in the closed position, in some embodiments of the disclosed technology, the slider rests flush with one of the left or right side of the housing. An upwardly extending handle on the slider edge assists in grasping and pulling the slider out from the housing and pushing the slider back in the housing. In some embodiments of the disclosed technology, a downwardly extending protrusion of the slider rides along a series of arched ridges providing progressive tactile feedback to assist in predictably calibrating, without visual guidance, the applicable extension length to interact with the appliance magnetic sensor, and selectively engages with an interactive braking system that comprises a recessed opening located at the anterior of the lower-center section of the housing, and an upwardly extending barrier found directly adjacent thereto and configured to prevent the slider from being fully pulled out from the housing as the downwardly extending protrusion locks into the recessed opening while abutting the elevated barrier.

A timer alarm switch, in some embodiments of the disclosed technology, is indented into the top side of the housing of the magnetic Sabbath switch. Depressing the timer alarm switch on the initial eve of the Sabbath after installation, or at any time thereafter, activates a perpetual alarm that will recurrently sound in, for example, exactly seven days time and/or a shorter amount of time, such as half hour or one hour before the seven days time, serving as a convenient audible reminder to pull out the slider over the appliance surface covering the magnetic sensor each week before the Sabbath begins. Other features of the timer alarm switch include cancelling the weekly alarm, shifting the interval of days between alarms, changing the alarm sounds, patterns, and volume, and creating recorded customized messages to be used instead of the standard alarm sounds. The timer alarm switch can be also be configured to automatically deactivate by coupling its functions to the magnetic force, or lack thereof, emanating from the magnetic slider as it is pulled from or pushed to the housing, and to automatically extract the slider from the housing each week before the Sabbath begins, and automatically retract the slider once the Sabbath concludes.

The combination of the fixed housing, the movable magnetic slider, and the audible timer alarm switch provides a novel solution to the problems discussed herein, whereby the housing is permanently mounted onto the appliance surface, thus eliminating the need for any weekly device attachment thereto; the magnet in the slider replicates the functionality of a closed appliance door by engaging the magnetic sensor and disabling electronic functions, thus allowing the appliance's use on the Sabbath; the movable slider allows the user to selectively enable the device before the Sabbath starts and disable the device after it ends, thus restoring the appliance to its proper working order during weekday use; and the audible timer alarm and automation provides both critical weekly reminders and worry-free operation, thus eliminating concern over transgressing the Sabbath by forgetting to activate the device, inevitably leading to turning on the appliance lights and other electronic functions when the door is opened.

One uses the magnetic Sabbath switch by adhering the bottom side of the housing to the external appliance surface alongside the area above the covered magnetic sensor, and once installed, by moving the slider from the closed to opened position, causing the electronic circuit within the appliance to change in status from closed to opened, and by returning the slider to the closed position, causing the electronic circuit within the appliance to change in status from opened to closed.

Described another way, one attaches to the appliance surface a housing incorporating a magnetic member that is slidable with respect thereto, wherein the housing is interposed between, and offset from the appliance magnetic sensor that controls electronic functions, thereby preventing it from magnetically affecting the electronic circuitry of the appliance until the slider is physically pulled out from the housing over the magnetic sensor before the Sabbath begins, to open the electronic circuit by magnetic force and to disable all auxiliary electronic functions normally disabled when the appliance door is closed.

One can further use the magnetic Sabbath switch by pushing the slider away from the area over the appliance magnetic sensor and back into the housing once the Sabbath ends, thereby eliminating the external, stronger magnetic force of the slider in favor of the internal, weaker magnetic force of the sensor itself, in order to revert the electronic circuit to its default closed position and re-supply electrical current to the auxiliary appliance functions normally enabled when the appliance door is opened.

One can further use the magnetic Sabbath switch by depressing the timer switch button on the top of the housing to configure, personalize, and activate a perpetual weekly reminder to manually move the slider over the appliance magnetic sensor before the Sabbath, or activate the automatic operation thereof.

Additional embodiments of the disclosed technology can be described as a magnetic switch that is adapted for use by Sabbath observers and is comprised of a housing with a bottom, top, front, rear, left, and right sides, and a slider that slides along a single axis, as compared to a device held stationary relative thereto, containing an embedded magnet that is moved therewith as it slidably engages with the housing by way of the lateral tracks situated therein. The slider is slidable between the closed and opened positions. In the closed position, the magnet is situated directly and vertically above the bottom side of the housing in a bottom-plan view thereof, with the magnet being in or hidden from an area defined by the bottom side. In the opened position, the magnet is situated vertically outside of the plane defined by the bottom side in a bottom-plan view thereof, with the magnet being outside of a region enclosed by the bottom side.

In some embodiments of the disclosed technology, a cutout region of the housing is open to the top and right sides while being closed to the bottom and left sides thereof, with both the right and left sides being interchangeable as the device is rotated 180 degrees, which is adapted to substantially fit the slider therein. In some embodiments of the disclosed technology, an adhesive pad is attached to the bottom side of the housing, which is then mounted onto the appliance surface, and in other embodiments, a magnet is used thereon. In either case, a magnetic sensor within an appliance causes the electronic functions thereof to change as the sensor detects any change in the magnetic field above, in embodiments of the disclosed technology. In the closed position, the slider and magnet are both completely vertically above the plane, as defined by the bottom side of the housing, and the shielded magnetic force is prevented from changing the electronic functions of the appliance. In the opened position, the magnetic slider emerges unprotected from the housing, and the ensuing exposed magnetic field causes the electronic functions of the appliance to change, in embodiments of the disclosed technology.

The tracks situated within the housing, in embodiments of the disclosed technology, are parallel. Further, a top-facing side of the cutout section can have a series of arched ridges, comprising alternating protrusions and indents, with which a downwardly extending protrusion of the slider engages when it is extended from the housing. A bottom side of the cutout region has an upwardly extending barrier rising in parallel to the left or right side of the housing, stopping the downwardly extending protrusion of the slider from exiting the housing when the slider is slid laterally away from the housing, in embodiments of the disclosed technology. The upwardly extending barrier can further prevent the slider from being laterally removed from the housing due to the abutment of the slider there-against.

A timer alarm switch can be present on the upper exterior side of the housing, in embodiments of the disclosed technology, such that depressing the top side thereof activates a timer alarm which causes a weekly audible tone and/or activates the automatic weekly operation of the device. Such a weekly audible tone or automatic operation can be deactivated upon pressing the timer alarm switch or manually moving the slider from the closed position to the opened position.

One can use the described switch by attaching the bottom side of the housing to the outer surface of an appliance and extending the slider from the closed position to the opened position, which uncovers the magnetic force of the magnet and causes the electrical circuit within the appliance to change, disabling the electronic functions of the appliance, in embodiments of the disclosed technology. One can retract the slider back into the housing by moving the slider from the opened position to the closed position, wherein the magnet is fully shielded by the housing, which prevents the electrical circuit within the appliance from disabling the auxiliary electronic functions thereof.

Any device or any step to a method described in this disclosure can comprise, or consist of, that which it is a part of, or the parts of which make up the device or step. The term "and/or" is inclusive of the items which it joins linguistically, and each item by itself. Any object described can thus be as described or "substantially" as such, defined as "at least 95% true" or "at least 95% of the amount specified".

BRIEF DESCRIPTION OF THE DRAWINGS

More specifically.

DETAILED DESCRIPTION OF EMBODIMENTS OF THE DISCLOSED TECHNOLOGY

A Sabbath switch with a circular magnet fixed inside a slider is disclosed herein. A housing with a slider is attached, such as with an adhesive pad or rare-earth magnet, to an appliance surface at the place directly adjacent to and over an embedded magnetic sensor. A programmable timer alarm indented into the top of the housing provides an audible reminder to operate the device before the start of the Sabbath, or have it automatically done weekly. The slider extends from the housing such that the stronger magnet inserted therein is situated directly over the weaker magnetic sensor beneath, causing an electrical change by opening the circuit and disabling the auxiliary functions within the appliance. It should be understood that while use with appliances on the Sabbath is mentioned, and while operation is described as opening the circuit to interrupt the flow of electric current, any magnetically-actuated switch that is used to either open or close any circuit for any purpose can be fitted with the device of the disclosed technology.

Embodiments of the disclosed technology becomes clearer in view of the following description of the accompanying drawings of embodiments of the disclosed technology.

While the drawings are described with reference to the "right" side, the "right" and "left" sides are interchangeable for the purposes of this disclosure when the device is rotated 180 degrees. The "top" side refers to the side of the housing 1 that is open to part of the slider 2, and the "bottom" side is the opposite side thereof, such as the side which is attached to an appliance surface.

FIG. 1 shows the standard-height, standard-bottom magnetic Sabbath switch of embodiments of the disclosed technology. FIG. 1*a* shows a top-plan view of the closed magnetic Sabbath switch with a standard height and standard bottom, in an embodiment of the disclosed technology. FIG. 1*b* shows a side-elevation view of the closed magnetic Sabbath switch of FIG. 1*a*. FIG. 1*c* shows a top-plan view of the opened, standard-height and bottom magnetic Sabbath switch, in an embodiment of the disclosed technology. FIG. 1*d* shows a side-elevation view of the opened magnetic Sabbath switch of FIG. 1*c*.

Figure 1A:
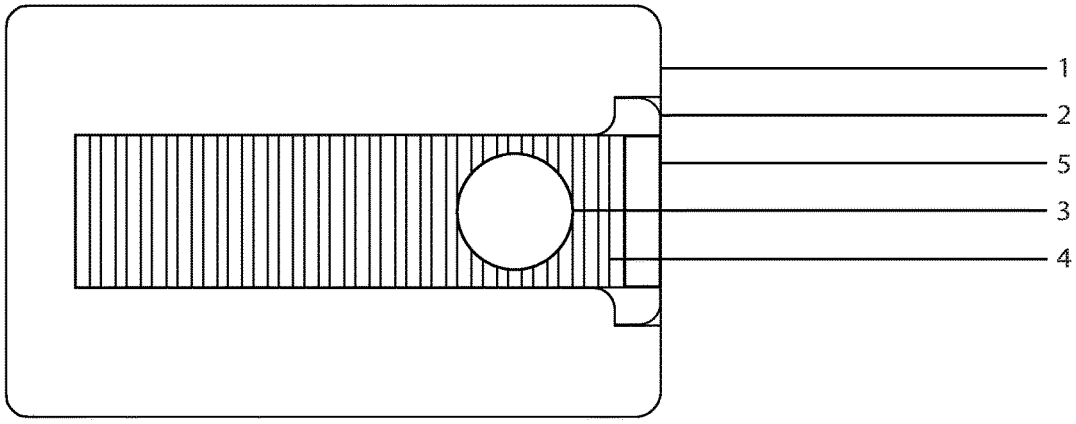
FIG. 1*a* shows a top-plan view of the closed magnetic Sabbath switch with a standard height and standard bottom, in an embodiment of the disclosed technology.

In FIG. 1*a*, one can see the housing 1 of the magnetic Sabbath switch is in a rectangular shape, the top side thereof enclosing a slider 2 situated therein that is held, in part, by the top side of the housing 1 extending over the top parts of the lateral edges of the slider 2 until the covering over the slider 2 broadens at the extreme right side of the housing 1.

Figure 1B:
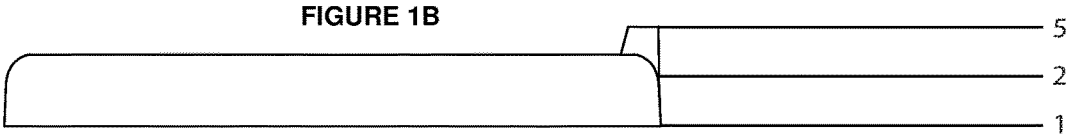
FIG. 1*b* shows a side-elevation view of the closed magnetic Sabbath switch of FIG. 1*a*.
Figure 1C:
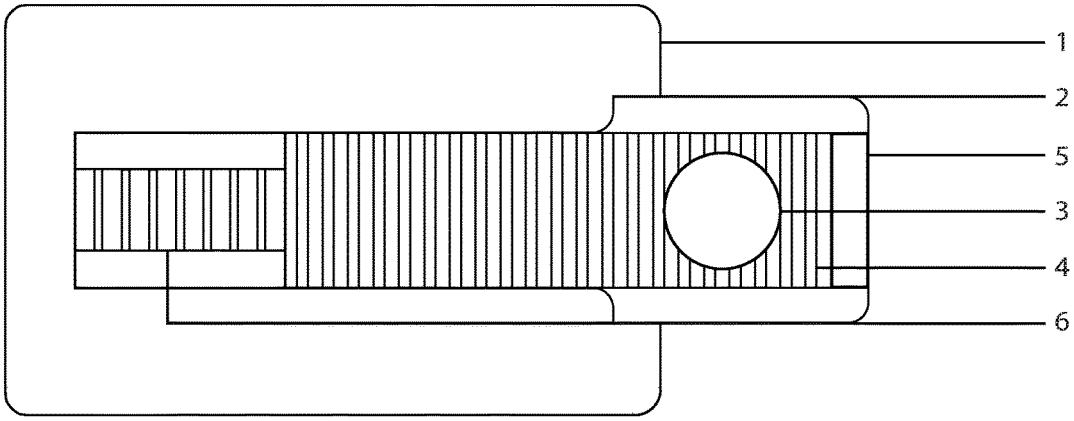
FIG. 1*c* shows a top-plan view of the opened, standard-height and bottom magnetic Sabbath switch, in an embodiment of the disclosed technology.
Figure 1D:
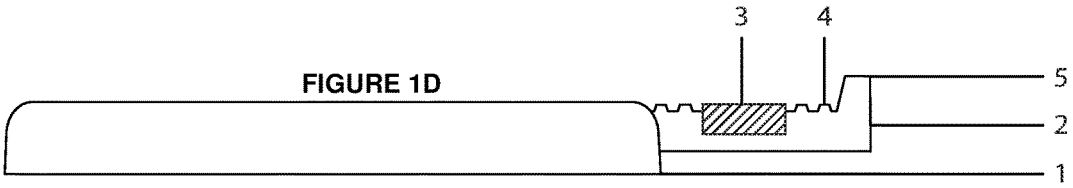
FIG. 1*d* shows a side-elevation view of the opened magnetic Sabbath switch of FIG. 1*c*.
Figure 2A:
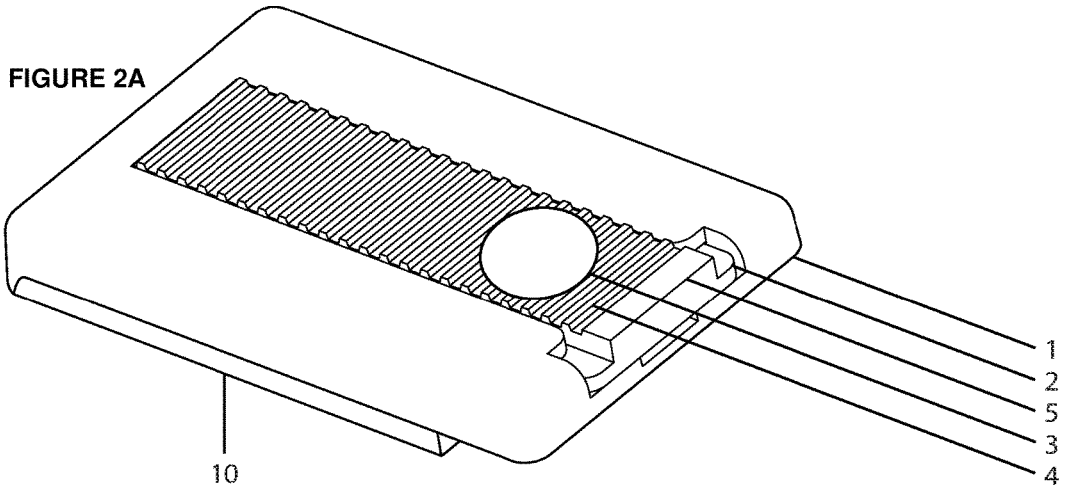
FIG. 2*a* shows a top-plan view of the closed magnetic Sabbath switch with extra height and narrow bottom, in an embodiment of the disclosed technology.
Figure 2B:
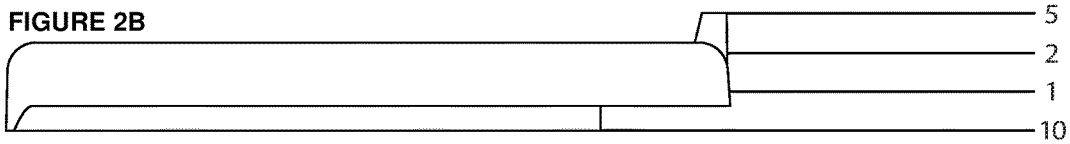
FIG. 2*b* shows a side-elevation view of the closed magnetic Sabbath switch of FIG. 2*a*.
Figure 2C:
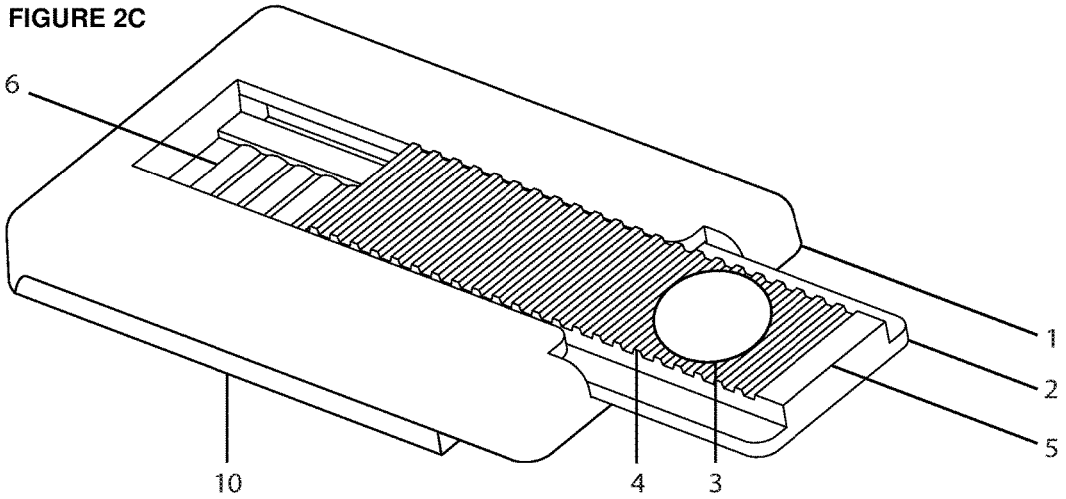
FIG. 2*c* shows a top-plan view of the opened, extra-height and narrowed-bottom magnetic Sabbath switch, in an embodiment of the disclosed technology.
Figure 2D:
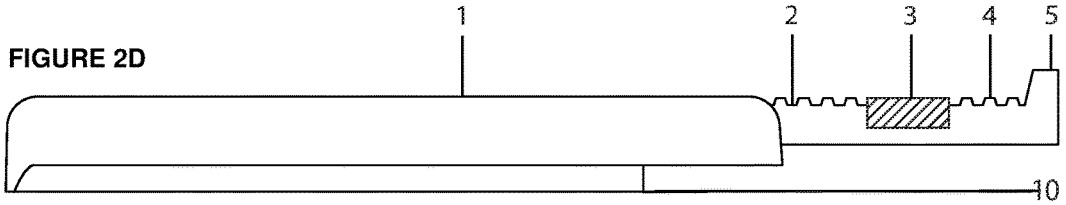
FIG. 2*d* shows a side-elevation view of the opened magnetic Sabbath switch of FIG. 2*c*.

Still referring to FIG. 1, and more specifically to FIGS. 1*a* and 1*b*, a round magnet 3 is enclosed within, and moves with the slider 2. In FIGS. 1*c* and 1*d*, one can see when the slider 2 extends from the housing 1 far enough, the magnet 3 is no longer over the physical vertical plane defined by the dimensions of the housing 1, but enters into an imaginary vertical plane defined by the appliance magnetic sensor that is situated adjacent thereto directly beneath the surface. In FIGS. 1*a* and 1*b*, the magnet 3 resides within the physical vertical plane of the housing 1. In FIGS. 1*c* and 1*d*, the magnet 3 within the slider 2 has been extended beyond the physical vertical plane and hovers above the imaginary vertical plane, and because it is no longer shielded by the physical confines of the housing 1, the magnet 3 radiates its magnetic force over the area below, magnetically actuating the appliance sensor to open the electronic circuit.

Referring still to FIG. 1, and more specifically to FIGS. 1*a*, 1*b*, 1*c*, and 1*d*, one can see the upper side of the lower-center section of the housing 1 is comprised of a series of arched ridges 6 configured to assist in calibrating the appropriate sliding distance across the area of the magnetic appliance sensor, and the upper side of the slider 2 has alternating grooves and ridges 4 to assist in drawing the slider 2 out from, and pushing it back into the housing 1, in addition to a raised grip 5 found at the extreme right end thereof, rising vertically to the upper-most extent, or beyond the upper-most extent of the housing 1, with which to extract the slider 2 from, and retract it back into the housing 1.

FIG. 2 shows the extra-height, narrowed-bottom magnetic Sabbath switch of embodiments of the disclosed technology. FIG. 2*a* shows a top-plan view of the closed magnetic Sabbath switch with extra height and narrow bottom, in an embodiment of the disclosed technology. FIG. 2*b* shows a side-elevation view of the closed magnetic Sabbath switch of FIG. 2*a*. FIG. 2*c* shows a top-plan view of the opened, extra-height, and narrowed-bottom magnetic Sabbath switch, in an embodiment of the disclosed technology. FIG. 2*d* shows a side-elevation view of the opened magnetic Sabbath switch of FIG. 2*c*.

In FIGS. 2*a*, 2*b*, 2*c*, and 2*d*, one can see the slider 2 within a cutout region of the housing 1 with force applied in a direction transverse to the top side and towards the right side of the housing 1, moving the slider 2 with its equipped magnet 3 out from the physical vertical plane of the housing 1, as the lower protrusion of the slider 2 engages with a series of repeating arched ridges 6, pulling either the alternating grooves and ridges 4 on the upper side of the slider 2, or the raised grip 5 on the extreme right side of the slider 2, such that the magnet 3 exits the physical vertical plane of the housing 1 and enters the imaginary vertical plane of the appliance magnetic sensor located directly adjoining thereto, with its magnetic force thus fully engageable therewith, as it is no longer obstructed by the housing 1.

Still referring to FIG. 2, and more specifically to FIGS. 2*a*, 2*b*, 2*c*, and 2*d*, the bottom side of the housing 1 extends slightly downward and substantially, but not entirely lengthwise from the extreme lower left side of the housing 1 towards the right side thereof, leaving a perpendicular void 10 completely widthwise at the extreme lower right side of the housing 1, the purpose of which is to allow the resulting projection at the extreme upper right side of the housing 1 to hover freely above the area of the appliance magnetic sensor without being obstructed by the raised sensor cover, in order to ensure the magnetic force of the device is properly aligned with the appliance magnetic sensor therebeneath.

FIG. 3 shows the individual housing and slider components of the magnetic Sabbath switch of embodiments of the disclosed technology. FIG. 3*a* shows a top-plan view of the housing component of the magnetic Sabbath switch without the slider and associated magnet, in an embodiment of the disclosed technology. FIG. 3*b* shows a side-cutaway view similar to that of FIG. 3*a*. FIG. 3*c* shows a top-plan view of the slider and the magnet components of the magnetic Sabbath switch, in an embodiment of the disclosed technology. FIG. 3*d* shows a side-elevation view similar to that of FIG. 3*c*.

Figure 3A:
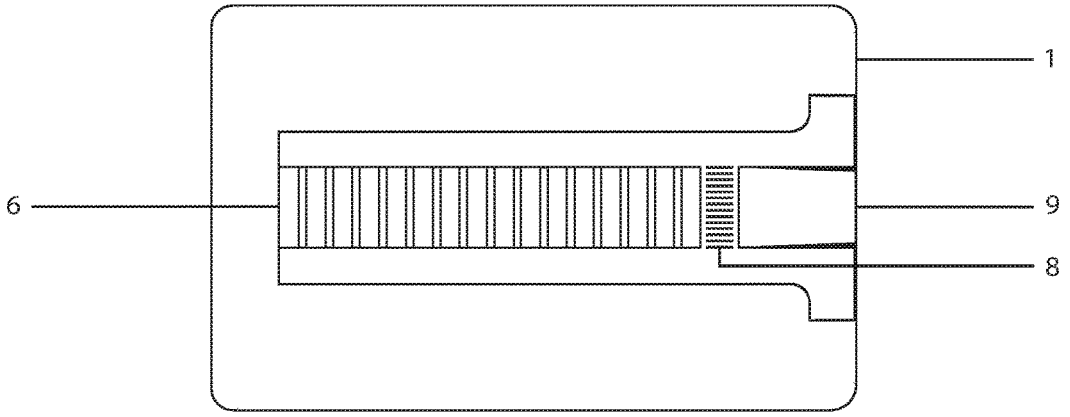
FIG. 3*a* shows a top-plan view of the housing component of the magnetic Sabbath switch without the slider and associated magnet, in an embodiment of the disclosed technology.
Figure 3B:
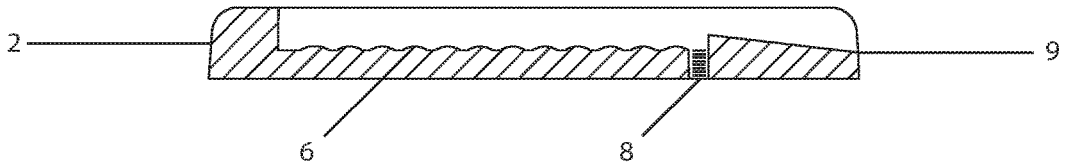
FIG. 3*b* shows a side-cutaway view similar to that of FIG. 3*a*.
Figure 3C:
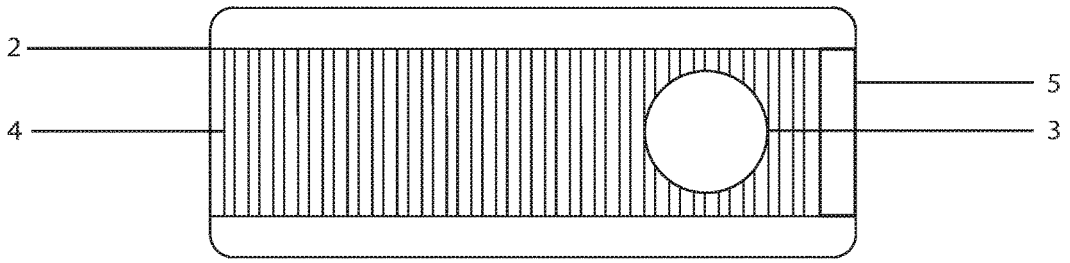
FIG. 3*c* shows a top-plan view of the individual slider and the magnet components of the magnetic Sabbath switch, in an embodiment of the disclosed technology.
Figure 3D:
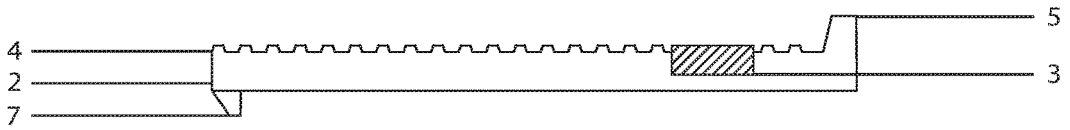
FIG. 3*d* shows a side-elevation view similar to that of FIG. 3*c*.

In FIGS. 3*a* and 3*b*, one can see a series of fixed arched ridges 6 beginning from the extreme left side of the upper-center portion of the bottom side of the housing 1, and extending laterally there-upon for substantially the entire length of the housing 1, terminating with a braking system comprised of a recessed opening 8 and upwardly extending barrier 9. In FIGS. 3*c* and 3*d*, one can see a succession of alternating grooves and ridges 4 beginning from the extreme left side of the upper-center portion of the top side of the slider 2 and extending laterally thereon for substantially the entire length of the slider 2, terminating with a raised grip 5, which extends medially for substantially the entire width of the slider 2. One also sees the round magnet 3 inserted into the slider 2 and downwardly extending protrusion 7 on the extreme left side of the bottom of the slider 2 that engages with the arched ridges 6 there-beneath.

Specifically with reference to FIGS. 3*b* and 3*d*, one can see that when pulling the slider 2 from the physical vertical plane of the housing 1 by means of either the alternating grooves and ridges 4 or the raised grip 5 positioned at the upper side thereon, the downwardly extending protrusion 7 on the extreme bottom-left side of the slider 2 is pulled along the sequence of arched ridges 6 occupying the upper-center portion of the bottom side of the housing 1, and provides tactile feedback to assist in calibrating the most accurate extension length within the imaginary vertical plane over the appliance magnetic sensor for the sliding magnet 3 to reliably actuate the electrical circuit thereof.

Still referring to FIGS. 3*b* and 3*d*, one can also see that when pulling the slider 2 outward from the physical vertical plane of the housing 1 to its maximally-opened position over the virtual vertical plane of the appliance magnetic sensor, the downwardly extending protrusion 7 of the slider 2 is locked into a recessed opening 8 positioned at the extreme right of the continuous arched ridges 6 on the upper-center area of the bottom side of the housing 1 and abutting the upwardly extending barrier 9 directly adjoining thereto, preventing the slider 2 from extending any further and exiting the housing 1 during operation.

To the extent of the descriptions provided, it should, of course, be understood that these features of the slider 2 are taught by way of inclusion in the embodiments of the disclosure, and does not limit the use of other various sliders having only one, two, or neither of the alternating grooves and ridges 4, raised grip 5, or downwardly extending protrusion 7. It is similarly understood that the features of the housing 1 are taught by way of inclusion in these embodiments of the disclosure, and does not limit any use of other distinctive housings which comprise of only some or none of the aforementioned elements, including the series of sequentially arched ridges 6, the recessed opening 8, or the upwardly extending barrier 9.

Figure 4A:
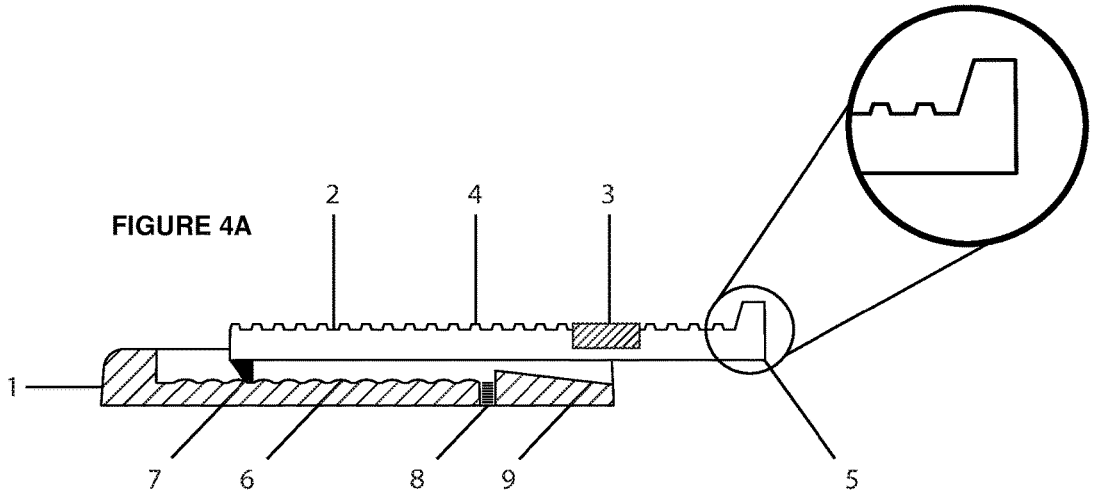
FIG. 4*a* shows side-cutaway and side-elevation views of the housing and the slider, with a magnified view of the raised grasp for pulling the slider from and pushing it into the housing, in an embodiment of the disclosed technology.
Figure 4B:
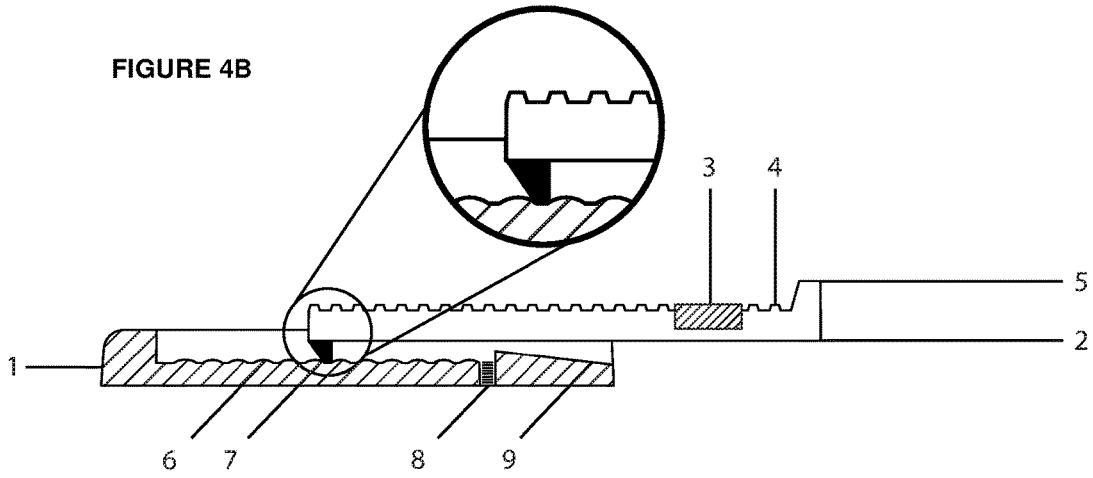
FIG. 4*b* shows side-cutaway and side-elevation views similar to those of FIG. 4*a*, with a magnified view of the downward protrusion of the slider advancing along an arrangement of arched ridges, in an embodiment of the disclosed technology.
Figure 4C:
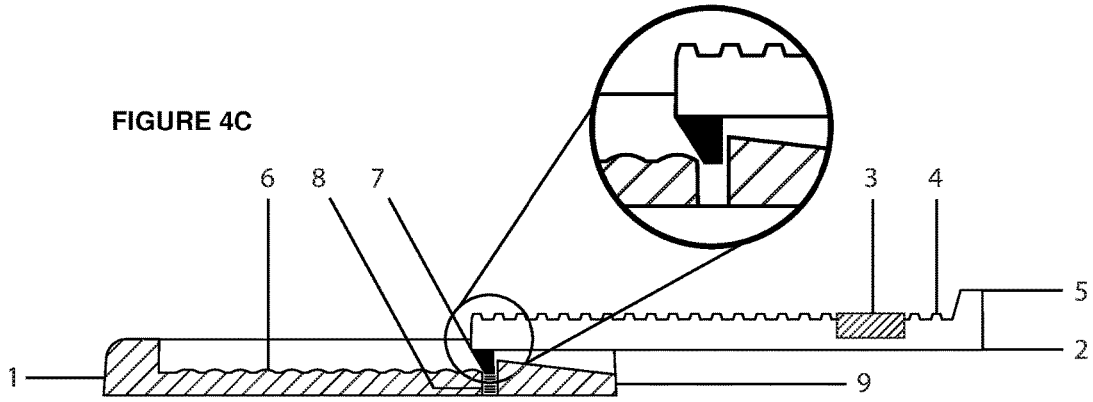
FIG. 4*c* shows side-cutaway and side-elevation views which are similar to that of FIG. 4*b*, with a magnified view of the downward protrusion of the slider wedged in place from the braking system by locking into the recessed opening and abutting the elevated barrier of the housing, in an embodiment of the disclosed technology.

FIG. 4 shows the housing and slider sections of the magnetic Sabbath switch of embodiments of the disclosed technology. FIG. 4*a* shows side-cutaway and side-elevation views of the housing and slider with a magnified view of the raised grasp for pulling the slider from and pushing it into the housing, in an embodiment of the disclosed technology. FIG. 4*b* shows side-cutaway and side-elevation views similar to those of FIG. 4*a*, with a magnified view of the downward protrusion of the slider advancing along an arrangement of arched ridges, in an embodiment of the disclosed technology. FIG. 4*c* shows side-cutaway and side-elevation views which are similar to that of FIG. 4*b*, with a magnified view of the downward protrusion of the slider wedged in place from the braking system by locking into the recessed opening and abutting the elevated barrier of the housing, in an embodiment of the disclosed technology.

In FIG. 4*a*, one can see the downwardly extending protrusion 7 of the slider 2 moving along a fixed track of arched ridges 6 toward the recessed opening 8 and the upwardly extending barrier 9 of the housing 1, with the slider 2 in the minimally-opened position and the attached magnet 3 partially exposed. One can also see a magnified view of the raised grip 5, which is used, along with the alternating grooves and ridges 4, to facilitate the process of pulling out and pushing in the slider 2 with respect to the housing 1. In FIGS. 4*b* and 4*c*, one can see the downwardly extending protrusion 7 of the slider 2 engaging with the series of arched ridges 6 of the housing 1 in both the moderately-opened and maximally-opened positions respectively, fully exposing the inbuilt magnet 3 above the area of the appliance magnetic sensor, with the assistance of the alternating grooves and ridges 4 and raised grip 5 of the slider 2.

Specifically referring to FIG. 4*b*, one can see a magnified view of the downwardly extending protrusion 7 of the slider 2, designed to assist in calibrating the optimum extension length of the slider 2, resting between the line of arched ridges 6 of the housing 1. Referring further to FIG. 4*c*, one can see a magnified view of the downwardly extending protrusion 7 locked into the recessed opening 8 and braced against the upwardly extending barrier 9 of the housing 1, designed to prevent the slider 2 from separating therefrom. In this manner, such as in FIGS. 4*a*, 4*b*, and 4*c*, as the slider 2 is extended from the housing 1, the integral magnet 3 can achieve its purpose of actuating the appliance magnetic sensor directly beneath and interrupting the flow of electrical current to the auxiliary electronic functions of the appliance.

Figure 5A:
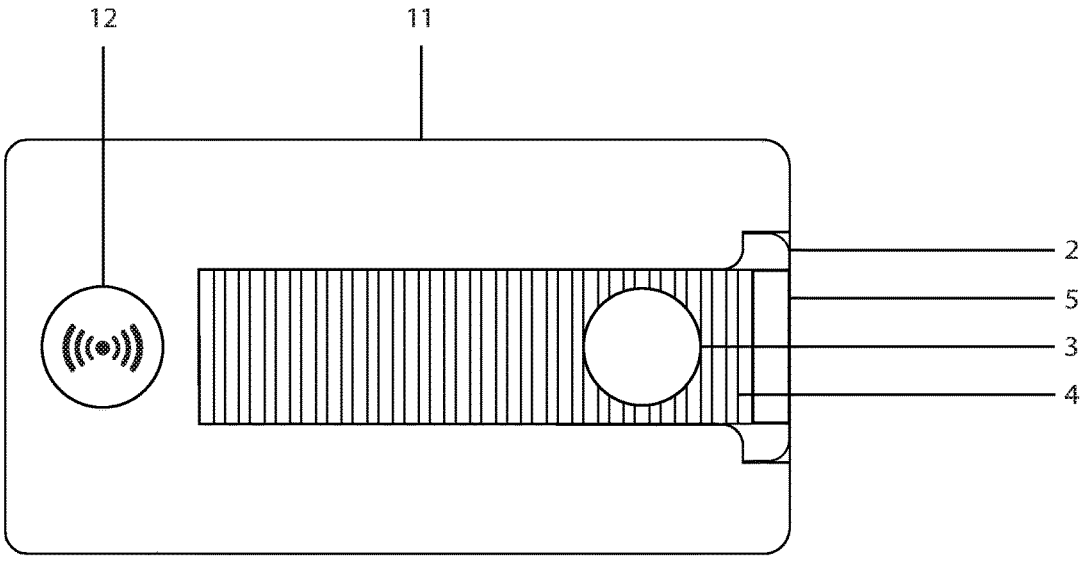
FIG. 5*a* shows a top-plan view of the closed magnetic Sabbath switch with a pressable timer alarm switch button on the top side of the housing, in an embodiment of the disclosed technology.
Figure 5B:
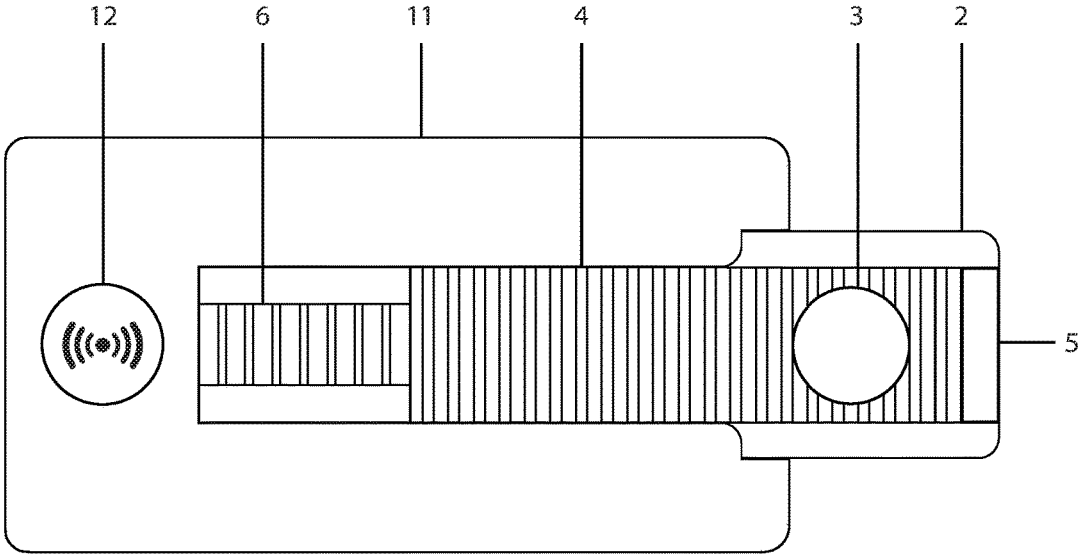
FIG. 5*b* shows a top-plan view of the opened magnetic Sabbath switch with the pressable timer alarm switch button on the top side of the housing, in an embodiment of the disclosed technology.

FIG. 5 shows the magnetic Sabbath switch with a timer alarm switch button of embodiments of the disclosed technology. FIG. 5*a* shows a top-plan view of the closed magnetic Sabbath switch with a pressable timer alarm switch button on the top side of the housing, in an embodiment of the disclosed technology. FIG. 5*b* shows a top-plan view of the opened magnetic Sabbath switch with the pressable timer alarm switch button on the top side of the housing, in an embodiment of the disclosed technology.

In FIGS. 5*a* and 5*b*, beyond a sequence of arched ridges 6, along which the slider 2 and fastened magnet 3 are pulled by either alternating grooves and ridges 4 or a raised grip 5 positioned on the top and right sides thereof, one can see an extended housing 11 with a timer alarm switch button 12 programmed to perpetually remind the user on a weekly basis, by means of an audible tone or self-recorded message, to pull the slider 2 away from the shielded, physical vertical plane of the extended housing 11 and across the exposed, virtual vertical plane of the appliance magnetic sensor before the Sabbath begins, for either a fixed number of minutes, or until the timer alarm switch button 12 is pressed again, or detects a reduced magnetic force as the sliding magnet 3 moves away from the extended housing 11. Further embodiments of the disclosed technology incorporate the automation of the weekly process of activating the magnetic Sabbath switch, whereby pressing the timer alarm switch button 12 automatically extracts and retracts the slider 2 before and after the Sabbath at a weekly or other preset time interval.

Figure 6:
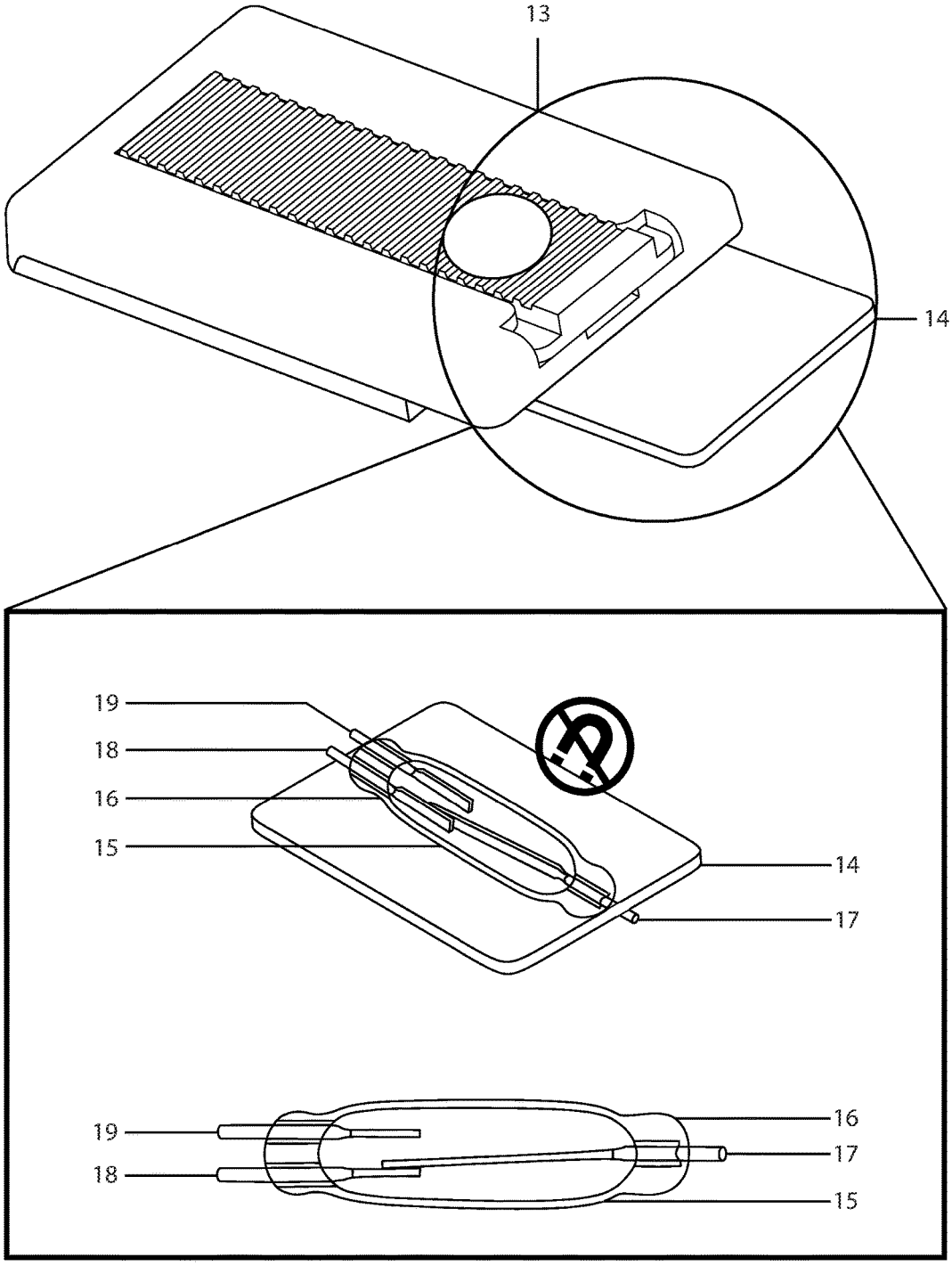
FIG. 6 shows the magnetic Sabbath switch of embodiments of the disclosed technology and the raised appliance sensor cover that is interposed between the location of the extended slidable magnet and the embedded magnetic sensor of the appliance there-beneath.

FIG. 6 shows the magnetic Sabbath switch of embodiments of the disclosed technology and the raised appliance sensor cover interspaced between the location of the extended slidable magnet and the internal appliance magnetic sensor underneath. FIG. 6*a* shows a top-side-perspective view of the closed magnetic Sabbath switch immediately adjoining the raised appliance sensor cover that is located beneath the space of the extended slidable magnet and above the appliance magnetic sensor, in an embodiment of the disclosed technology. FIG. 6*b* shows a top-side-perspective view of the magnetic sensor ensconced underneath the sensor cover without external magnetic force from the magnetic Sabbath switch disrupting the electrical current from the appliance power supply and deactivating the auxiliary electronic functions connected thereto. FIG. 6*c* shows a magnified side-elevation view of the magnetic sensor in its default self-magnetized, closed-circuit position, as when the appliance door is normally opened and the auxiliary electronic functions are turned on.

In FIG. 6*a*, one can see an embodiment of the closed magnetic Sabbath switch 13 as collectively shown in FIGS. 1 through 5, located directly adjacent to the raised appliance sensor cover 14 identifying the location beneath which the appliance magnetic sensor 15 is situated, the various components of which can be seen in FIGS. 6*b* and 6*c*.

Specifically referring to FIG. 6*b*, one can see the appliance magnetic sensor 15 directly beneath the raised appliance sensor cover 14, consisting of or comprising a glass capsule 16 within which situates on one side, a pivoting metallic common lead 17 distributing electrical current from the appliance power source, and on the opposite side, a fixed magnetic closed lead 18 that transfers the electrical current from the pivoting common lead 17 to the auxiliary electronic functions connected thereto, and a fixed metallic opened lead 19 that terminates the electrical current from the pivoting common lead 17, thereby disabling these connected auxiliary electronic functions.

Specifically referring to FIG. 6*c*, one can see a magnified side-elevation view of the appliance magnetic sensor 15 assembly, consisting of or comprising a glass capsule 16, a pivoting metallic common lead 17, a fixed magnetic closed lead 18, and a fixed metallic opened lead 19.

Still referring to FIGS. 6*b* and 6*c*, one can see that when no external magnetic force is exerted over the appliance magnetic sensor 15, as when the magnetic Sabbath switch 13 is in the closed position, the pivoting metallic common lead 17 is forcibly attracted to the fixed magnetic closed lead 18, creating a closed electronic circuit from the appliance power source for the electronic functions connected thereto.

Figure 7:
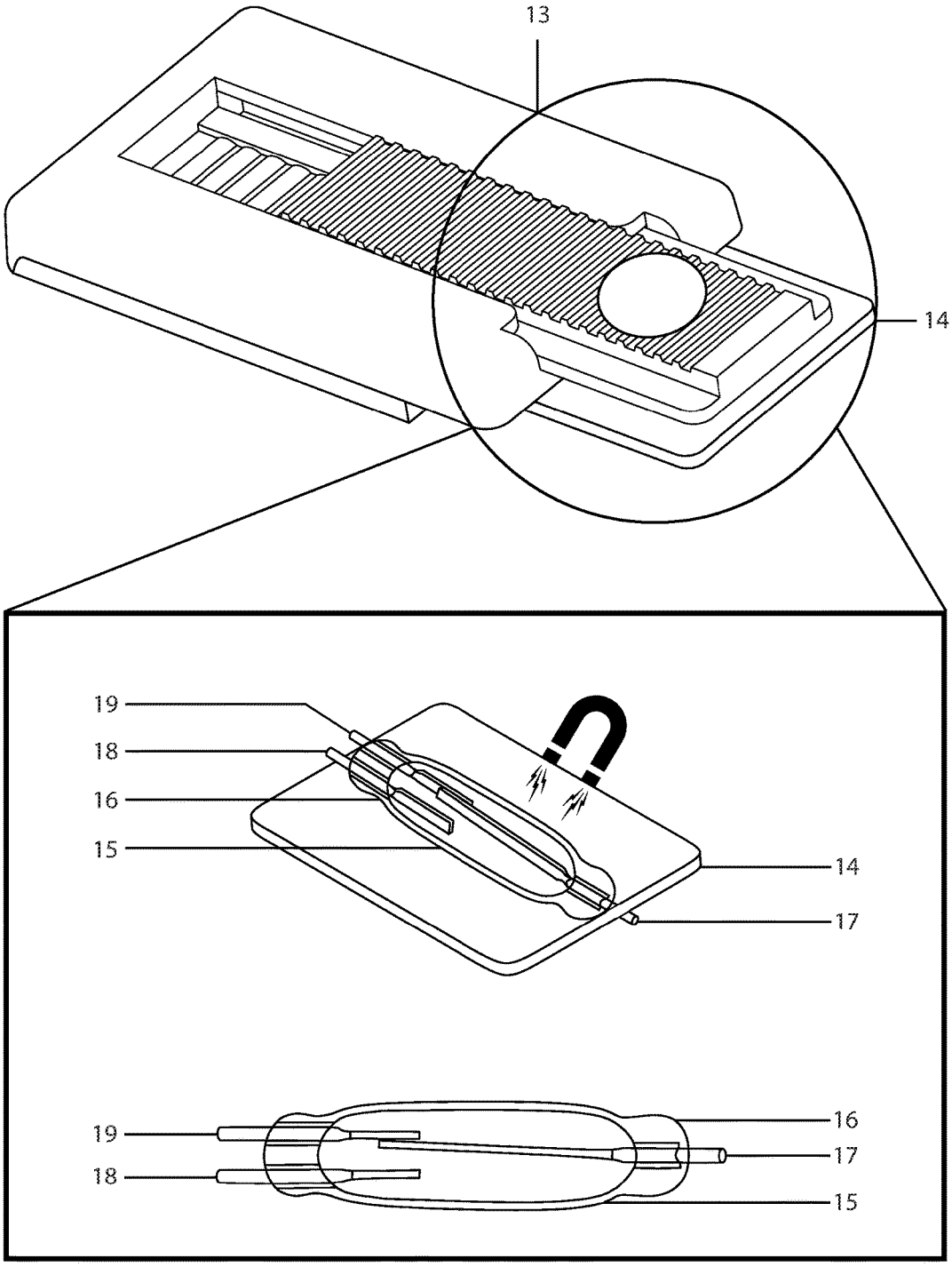
FIG. 7 shows the magnetic Sabbath switch of embodiments of the disclosed technology and the raised appliance sensor cover that is interposed between the location of the extended slidable magnet and the embedded magnetic sensor of the appliance there-beneath.

FIG. 7 shows the magnetic Sabbath switch of embodiments of the disclosed technology and the raised appliance sensor cover interspaced between the location of the extended slidable magnet and the internal appliance magnetic sensor underneath. FIG. 7*a* shows a top-side-perspective view of the closed magnetic Sabbath switch immediately adjoining the raised appliance sensor cover that is located beneath the space of the extended slidable magnet and above the appliance magnetic sensor, in an embodiment of the disclosed technology. FIG. 7*b* shows a top-side-perspective view of the appliance magnetic sensor obscured below the raised sensor cover, with the strong magnetic force of the magnetic slider terminating the electrical current and disrupting the electronic functions linked thereto. FIG. 7*c* shows a magnified side-elevation view of the magnetic sensor in the externally-magnetized, opened-circuit position, as when the appliance door is normally closed and the auxiliary electronic functions are turned off.

In FIG. 7*a*, one can see an embodiment of the closed magnetic Sabbath switch 13 as collectively shown in FIGS. 1 through 5, located directly adjacent to the raised appliance sensor cover 14 identifying the location beneath which the appliance magnetic sensor 15 is situated, the various components of which can be seen in FIGS. 7*b* and 7*c*.

Specifically referring to FIG. 6*b*, one can see the appliance magnetic sensor 15 directly beneath the raised appliance sensor cover 14, consisting of or comprising a glass capsule 16 within which situates on one side, a pivoting metallic common lead 17 distributing electrical current from the appliance power source, and on the opposite side, a fixed magnetic closed lead 18 that transfers the electrical current from the pivoting common lead 17 to the auxiliary electronic functions connected thereto, and a fixed metallic opened lead 19 that terminates the electrical current from the pivoting common lead 17, thereby disabling these connected auxiliary electronic functions.

Specifically referring to FIG. 7*c*, one can see a magnified side-elevation view of the appliance magnetic sensor 15 assembly, consisting of or comprising a glass capsule 16, a pivoting metallic common lead 17, a fixed magnetic closed lead 18, and a fixed metallic opened lead 19.

Still referring to FIGS. 7*b* and 7*c*, one can see that when a greater external magnetic force exerts over the appliance magnetic sensor 15 than is supplied by the fixed magnetic closed lead 18, as when the magnetic Sabbath switch 13 is in the opened position, the pivoting metallic common lead 17 is forcibly attracted away from the weaker fixed magnetic closed lead 18 toward the fixed metallic opened lead 19, thereby creating an opened electronic circuit that disrupts the flow of electricity to the auxiliary electronic appliance functions and disables their operation until the magnetic Sabbath switch 13 is closed.

Figure 8:
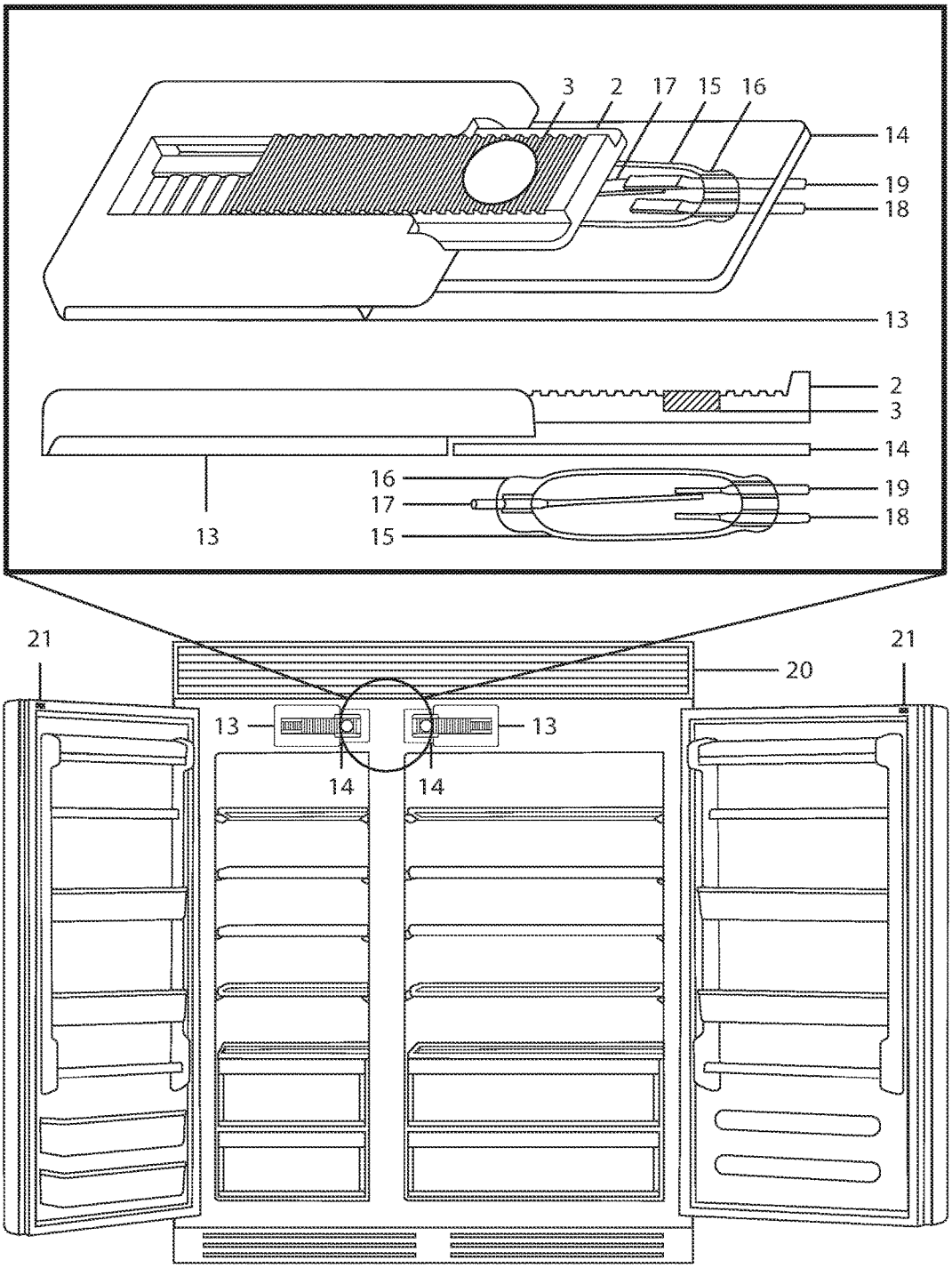
FIG. 8 shows the magnetic Sabbath switch of embodiments of the disclosed technology installed inside a working appliance as it regulates the internal magnetic sensor, disabling its electronic functions.

FIG. 8 shows the magnetic Sabbath switch of embodiments of the disclosed technology installed inside a working appliance as it regulates the internal magnetic sensor, disabling the electronic functions. FIG. 8*a* shows a front-elevation view of an opened refrigerator with its interior door magnets distanced from the magnetic sensors and replaced by two magnetic Sabbath switches mounted directly adjacent to the appliance sensor covers, in an embodiment of the disclosed technology. FIG. 8*b* shows a magnified top-side-perspective view of the opened magnetic Sabbath switch with a built-in magnetic slider extended on top of the sensor cover and magnetically opening the electrical circuit of the appliance magnetic sensor beneath, in an embodiment of the disclosed technology. FIG. 8*c* shows a magnified side-elevation view of the opened magnetic Sabbath switch similar to that of FIG. 8*b*, in which all operational elements are in proper vertical alignment for the device to achieve its purpose.

In FIGS. 8*a*, 8*b*, and 8*c*, one can see embodiments of the opened magnetic Sabbath switch 13 as collectively shown in FIGS. 1 through 5, directly adjacent to the raised appliance sensor cover 14 which marks the area below which the appliance magnetic sensor 15 lies and operates, the various components of which include a glass capsule 16, a pivoting metallic common lead 17, a fixed magnetic closed lead 18, and a fixed metallic opened lead 19.

Specifically referring to FIG. 8*a*, one can also see two magnetic Sabbath switches 13 deployed inside an opened refrigerator 20 adjacent to their respective raised appliance sensor covers 14 at the area where the appliance door magnets 21 would usually actuate their opposing magnetic appliance sensors 15 when the doors close, such that the magnetic Sabbath switches 13 effectively substitute their own magnetic force for that of the appliance door magnets 21, thereby permitting the refrigerator doors to be opened and closed on the Sabbath by keeping the electrical current suppressed and the electronic functions turned off.

Specifically referring to FIG. 8*b*, one can also see the slider 2 with a unified magnet 3 extending from the magnetic Sabbath switch 13 directly above the raised appliance sensor cover 14 which conceals the glass capsule 16 of the appliance magnetic sensor 15, and magnetically attracting the pivoting metallic common lead 17 away from the fixed magnetic closed lead 18 and to the fixed metallic opened lead 19, thereby suspending the flow of electrical current from the appliance power source normally reserved for energizing the auxiliary electronic appliance functions associated therewith.

Specifically with reference to FIG. 8*c*, one can also see the stacked vertical alignment of all the operational elements present in the disclosed technology, the extended slider 2 and connected magnet 3 of the magnetic Sabbath switch 13; the raised appliance sensor cover 14 situated directly underneath; and the appliance magnetic sensor 15 located beneath that, which is enclosed within a glass capsule 16 containing a pivoting metallic common lead 17, a fixed magnetic closed lead 18, and a fixed metallic opened lead 19, through which the electrical current of the appliance, and thus its electronic functionality, is regulated.

Still referring to FIG. 8*c*, one can also see the stronger magnetic force applied by the connected magnet 3 of the slider 2, powerfully drawing the pivoting metallic common lead 17 away from the weaker fixed magnetic closed lead 18 and binding it to the fixed metallic opened lead 19, thereby terminating the flow of electrical current to the electronic appliance functions that would otherwise turn on when the door is opened and turn off when the door is closed, both of which transgress the Sabbath and thus necessitate the solution of the disclosed technology presented herein.

With reference to FIGS. 1 through 8, a person having ordinary skill in the art will recognize how the magnetic Sabbath switch solves the very real and present problems for every observant Jew operating appliances on the Sabbath by providing a universal, inexpensive, permanent, and automated solution for selectively disabling and enabling the auxiliary electronic functions thereof before and after the Sabbath.

While the disclosed technology has been taught with specific references to the above-mentioned embodiments, a person having ordinary skill in the art will recognize that it is not restricted for use with appliances, or by persons of any particular religious faith, but with any device having a magnetic sensor, and by any person in need of regulating the electrical current thereof, and they will further recognize that changes may be made in both form and detail without departing from the spirit and scope of the disclosed technology. The so-described embodiments are to be considered in all respects only as illustrative and not restrictive, and all the changes that come within the meaning and range of equivalency of the claims made hereunder are to be included within their scope, and all combinations of any of the methods, systems, and devices described herein are also contemplated and within the scope of the disclosed technology.

I claim:

1. A magnetic Sabbath switch comprising:

a housing with a bottom, top, front, rear, left, and right side;

a slider having a magnet embedded in a cavity formed in upper portion of said slider, said slider being slidably engaged with said housing by way of tracks in said housing;

wherein said slider is slidable between a closed position and open position where:

in said closed position, said magnet is situated directly and vertically above and spaced apart from said bottom side of said housing; and in said opened position, said magnet is situated outside of a plane defined by said bottom side of said housing.

2. The magnetic switch of claim 1, comprising a cutout region of said housing, which is open to said top side and said right side while being closed to said bottom side and said left side, and which is adapted to substantially fit said slider therein.

3. The magnetic switch of claim 1, comprising an adhesive pad fixedly attached to an exterior of said bottom side.

4. The magnetic switch of claim 3, comprising an additional magnet fixedly attached to an exterior of said bottom side.

5. The magnetic switch of claim 1, wherein:

a magnetic sensor of an appliance causes a function of an appliance to change based on a change in magnetic field detected by said magnetic sensor;

in said closed position, said slider and said magnet are both entirely vertically above and spaced apart from said magnetic sensor within said appliance and from said plane defined by said bottom side, and said housing shields said magnet from changing said function of said appliance; and in said opened position, said magnet is unshielded by said housing such that said magnet causes said function of said appliance to change, wherein there is no direct engagement between said magnet and said appliance preventing wear there-on.

6. The magnetic switch of claim 2, wherein said tracks are parallel, and a top-facing side of said cutout section further comprises a series of arched ridges with which a downwardly extending protrusion of said slider engages when extended from said housing.

7. The magnetic switch of claim 6, wherein a bottom side of said cutout region comprises an upwardly extending barrier rising upwards in parallel to said left or said right side of said housing, preventing said downwardly extending protrusion of said slider from exiting from said housing when said slider is pulled laterally away from said housing.

8. The magnetic switch of claim 7, wherein said upwardly extending barrier prevents said slider from being laterally removed from said housing due to the abutment of said downwardly extending protrusion of said slider against said upwardly extending barrier.

9. The magnetic switch of claim 1, further comprising a timer alarm switch, wherein upon activation, said timer alarm switch causes a perpetual weekly reminder audible tone before the Sabbath, said audible tone being deactivated upon moving said slider from said closed position to said opened position.

10. The magnetic switch of claim 9, wherein upon activation, said timer alarm switch causes a weekly automation of extracting said slider from said closed position to said opened position before the Sabbath, and retracting said slider from said opened position to said closed position after the Sabbath concludes.

11. A method of using said magnetic Sabbath switch of claim 1, comprising the steps of attaching said bottom side of said housing to a surface of an appliance and:

extending said slider from said closed position to said opened position, thereby causing magnetic force from said magnet to cause an electrical change to an electrical circuit within said appliance.

12. The method of claim 11, wherein carrying out said method causes said electronic functions of said appliance to be disabled.

13. The method of claim 12, further comprising a step of retracting said slider back into said housing by way of moving said slider from said opened position to said closed position, wherein said magnet is thus sufficiently shielded by said housing to prevent said electrical circuit within said appliance from disabling said electronic functions thereof.

14. The magnetic switch of claim 1, wherein said cavity of said slider has a base, said base forming part of said slider, said base preventing said magnet from being pulled out of said cavity by a magnetic force external to said magnetic switch.

* * * * *